United States Patent [19]

Kim

[11] Patent Number: 4,916,919

[45] Date of Patent: Apr. 17, 1990

[54] PLASTIC PAN ASSEMBLY FOR USE IN AIR CONDITIONERS AND REFRIGERATORS

[76] Inventor: Il Y. Kim, 7953 Audubon Ave. B-7, Alexandria, Va. 22306

[21] Appl. No.: 381,261

[22] Filed: Jul. 18, 1989

[51] Int. Cl.[4] ..... F25D 21/02

[52] U.S. Cl. ..... 62/272; 62/285

[58] Field of Search ..... 62/272, 285, 286, 291, 62/288, 289; 248/274, 282, 295.1, 318

[56] References Cited

U.S. PATENT DOCUMENTS

| | | | |
|---|---|---|---|
| 1,950,344 | 3/1934 | Williams | 62/285 X |
| 1,975,066 | 9/1934 | Sanderson | 62/285 X |
| 4,597,269 | 7/1986 | Kim | 62/286 |
| 4,823,558 | 4/1989 | Kim | 62/272 |

*Primary Examiner*—Lloyd L. King

*Attorney, Agent, or Firm*—Birch, Stewart, Kolasch & Birch

[57] ABSTRACT

A plastic primary pan assembly for use in conjunction with an air conditioning system, wherein a channeled supporting bracket is utilized to tightly engage and effectively support a plastic pan which includes a drain plastic pan and a plastic support plate which contains a C-shaped circumferential portion and a C-shaped extending portion thereof, the channeled supporting bracket having a plurality of elongated apertures being mounted on a motor and a fan cover, whereby the plastic primary pan assembly can be easily associated with and separate from the air conditioning system and easily adjusted to incline the plastic primary pan for drawing condensate water through an outlet disposed in the plastic primary pan.

8 Claims, 2 Drawing Sheets

PLASTIC PAN ASSEMBLY FOR USE IN AIR CONDITIONERS AND REFRIGERATORS

BACKGROUND OF THE INVENTION

1. Field of the Invention

The present invention relates to a primary plastic pan assembly for use in conjunction with air conditioning installations and refrigeration systems, and more particularly to a plastic primary pan assembled with a supporting bracket which is mounted to a motor and a fan cover.

2. Description of the Prior Art

Primary pans are generally known to be utilized with air conditioning systems. Conventional devices utilize a primary pan made of steel which is directly mounted to a fan cover and a motor. However, these devices suffer from a number of problems such as, for example, the problem that metallic primary pans eventually become rusted and plug up outlets for draining water from the pan. Further, it is difficult for the pan to support the air condition system such as the motor and the pan cover, because of the additional weight caused by the metal pan, so that the motor cannot be used for a long time. It is also very difficult for the primary pans to separate from such devices because the structure is very complicated and device has a heavy weight.

In order to avoid such problems, U.S. Pat. No. 4,597,269, issued to the present inventor, discloses a plastic pan adapted to be mounted to the motor of an air conditioning system which includes a primary pan, a support bracket, height-adjustable brackets, and a motor mount bracket whereby the plastic pan avoids the plugging up of the outlet. However, this primary pan exhibits some problems with regard to convenient and reliable assembling and requires a lot of bolts for installation.

U S. Pat. No. 4,823,558, issued by the present inventor, discloses a plastic pan assembly for use in air conditioning systems and refrigerators wherein a plastic pan having a raised portion or a rail disposed on the outside surface of the bottom thereof is easily engaged with a channeled supporting bracket. However, this pan assembly requires a large space for working.

The present inventor is also prosecuting another U.S. patent application Ser. No. 07/286,863, filed Dec. 20, 1988, now allowed U.S. Pat. No. 4,862,704 which disclosed an improved primary pan for use in an air conditioning system which includes a C-shaped plastic pan having a raised portion or a rail disposed on the outside surface of the bottom thereof, a channeled supporting bracket having a plurality of elongated apertures for engaging the raised portion of the rail of the plastic pan, and a pair of fan covers having a channel disposed on the outside surface of the top and a circumferential raised portion disposed around a lower outlet thereof for effectively mounting to and separating from the supporting bracket to the plastic pan with only two pairs of screws. However, this pan assembly cannot apply to a specific air conditioning system having a narrow width thereof.

SUMMARY OF THE INVENTION

Accordingly, it is an object of the present invention to provide an improved plastic pan assembly for use in air conditioning systems and refrigerators.

Another object of the present invention is to provide a plastic primary pan which is structured for draining condensate water through an outlet while avoiding the plugging up of the outlet.

Still another object of the present invention is to provide an air conditioning system which includes an assembly for easily mounting a primary pan to a supporting bracket which has a plurality of elongated apertures and which is mounted to a motor and fan covers.

Yet another object of the present invention is to provide an improved primary pan for utilizing to a specific air conditioning system having a narrow width thereof.

A further object of the present invention is to provide an improved primary pan for smoothly mounting to an easily separating from an air conditioning system which includes a drain plastic pan, a C-shaped plastic support plate having a pair of end sides of the outside surface of a C-shaped top circumferential portion and a pair of end sides of C-shaped side circumferential portions thereof, a channeled supporting bracket having a plurality of elongated apertures, and a pair of fan covers having an elongated slot disposed on the outside surface of the top for receiving the supporting bracket, rails disposed on both lower sides of upper side walls raised portion disposed around a below outlet thereof for smoothly mounting the fan cover to and separating the fan cover from the pair of end sides of the C-shaped circumferential portion of the plastic support plate with only one screw.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a plastic primary pan assembly for use in conjunction with an air conditioning system, wherein a channeled supporting bracket is utilized to tightly engage and effectively support a plastic pan which includes a drain plastic pan and a plastic support plate which contains a C-shaped circumferential portion and a C-shaped extending portion thereof, the channeled supporting bracket having a plurality of elongated apertures being mounted on a motor and a fan cover, whereby the plastic primary pan assembly can be easily associated with and separate from the air conditioning system and easily adjusted to incline the plastic primary pan for drawing condensate water through an outlet disposed in the plastic primary pan.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
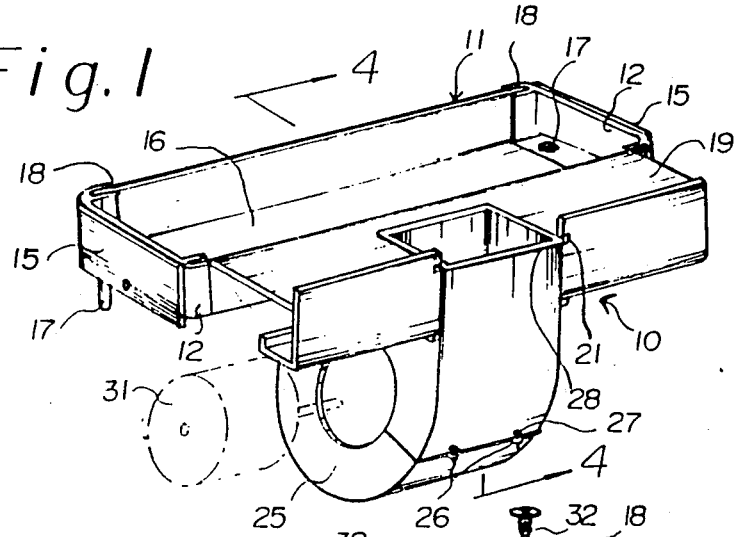
FIG. 1 is a perspective view of a plastic primary pan assembly with its associated support element.
Figure 2:
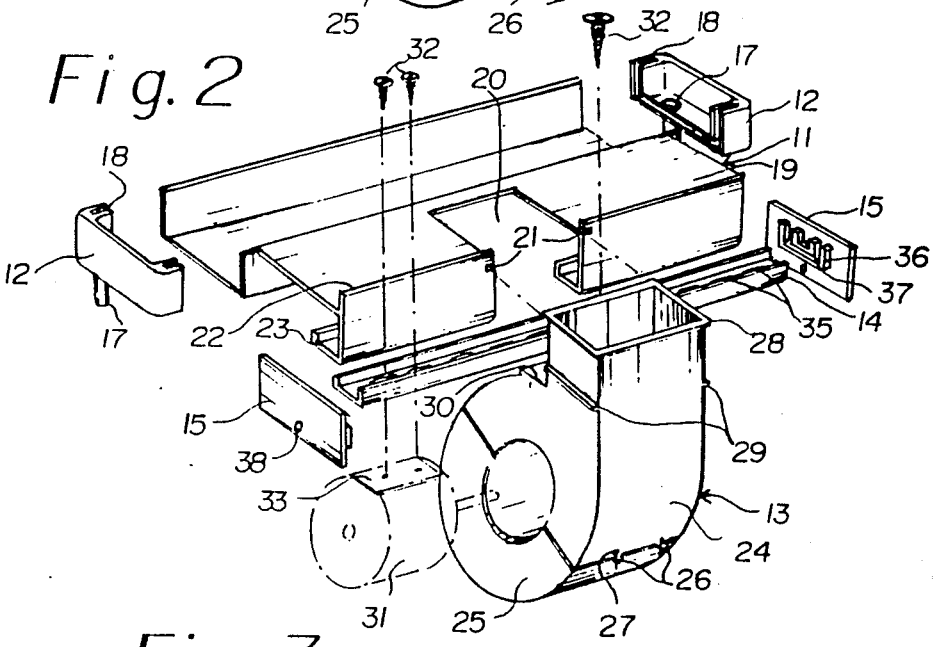
FIG. 2 is an exploded perspective view of showing basic components of a plastic primary assembly of the present invention.

Referring now in detail to the drawings for the purpose of illustrating preferred embodiments of the present invention, the plastic primary pan assembly 10 as shown in FIGS. 1 and 2 includes a plastic primary pan 12 having a plastic support plate 19, a channeled supporting bracket 14 which is mounted to a motor 31 and a fan cover 13.

The plastic primary pan 12 is provided with a plastic pan body 11 and two side walls 12 having drain pipes 17 disposed in both end portions thereof, respectively, for draining condensate water. The side walls 12 contain a rail 18 for tightly assembling with the both end of the pan body 11, respectively. Also, the plastic primary pan 12 extends the plastic support plate 19 which contains a C-shaped top circumferential portion 20 disposed on one side of the rectangular configuration thereof and C-shaped side circumferential portions 23 disposed on both sides of a C-shaped extending plate 23 extended from the plastic support plate 19. The channeled supporting bracket 14 for receiving the primary pan 12 contains a plurality of elongated apertures 35 for adjustably receiving a screw 32. The channeled supporting bracket 14 is provided with a pair of engaging plates 15 for supporting and engaging to a housing of the air conditioning system (not shown). The support plate 19 is provided with the extending plate 23 extended therefrom. The extending plate 23 extends a top plate portion 22 which contains a pair of slots 21 for slidably receiving a circumferential raised portion 28, of the fan cover 24 or slidably separating the fan cover therefrom with only one screw 32.

Figure 6:
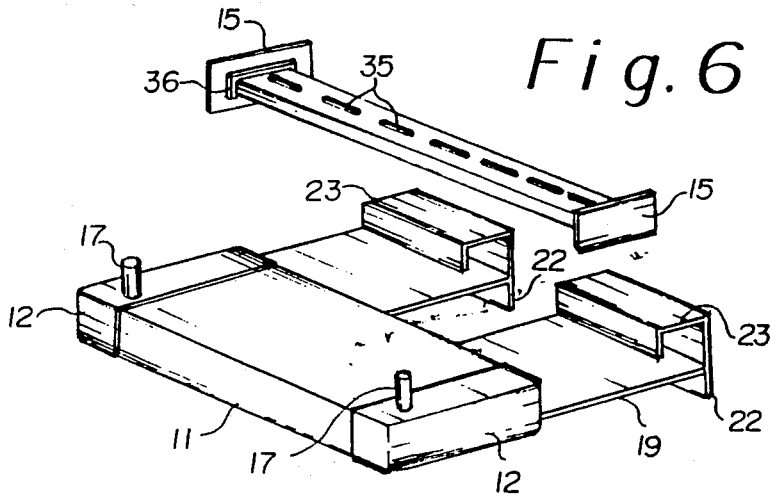
FIG. 6 is an exploded perspective view of the primary pan and supporting bracket of the present invention in a turned over position.

As shown in FIGS. 2 and 6, since the engaging plates 15 have U-shaped apertures 37 defined by U-shaped rail 36, respectively, the channeled supporting bracket 14 can be effectively engaged in the U-shaped channel 37 of the pair of plates 15. Also, the engaging plates 15 have an aperture 38, respectively, for inserting into walls of a housing of an air conditioning system.

Figure 4:
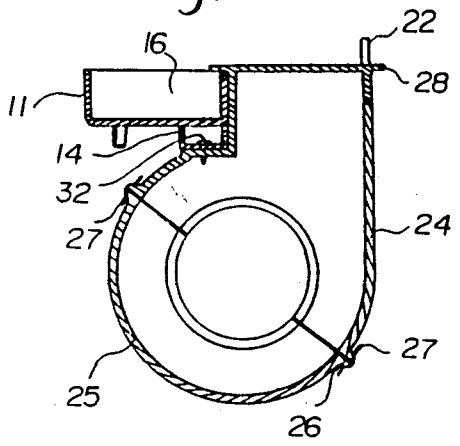
FIG. 4 is a sectional view of FIG. 1 showing the attachment of the pan cover to the plastic primary pan and supporting bracket of the present invention.
Figure 5:
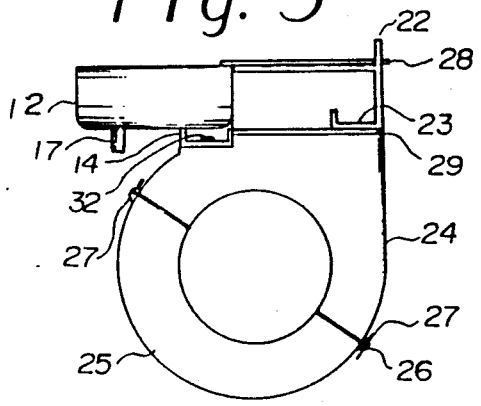
FIG. 5 is a side elevational view of FIG. 1 showing the attachment of the pan cover to the plastic primary pan including a plastic support plate with a C-shaped configuration and a supporting bracket of the present invention.

As shown in FIGS. 4 and 5, the fan cover 13 defined an upper fan cover 24 and a lower fan cover 25 contains a below outlet 28 which has the circumferential raised portion 28, for being adapted to suspend to the C-shaped circumferential portion 20 of the plastic support plate 19. The upper fan cover 24 has an elongated slots 30 disposed on the top surface thereof for receiving the supporting bracket 14 by a screw 32 through an aperture 34 of the upper pan cover 24. Thus the upper pan cover 24 includes the circumferential raised portion 28, disposed around the top portion of the below outlet 28 thereof and both side raised portions 29 disposed on the opposite sides thereof for easily mounting to and separating from the C-shaped circumferential portion 20 and end portions 23' of the extending portion 23 of the plastic support plate 19, respectively. Also, the fan cover 13 has pin engagements 26 disposed on the upper and lower pan covers 24 and 25, respectively, for receiving pins 27 to combine them together. The motor 31 is provided with a motor plate 33 for being mounted to the supporting bracket 14 by screws 32 through the apertures 34 of the motor plate 33. Accordingly, since the motor 31 is mounted to the straight supporting bracket 14, it is believed that the motor 31 can be maintained for along time when compared with the motor utilized the conventional air conditioning devices.

Figure 3:
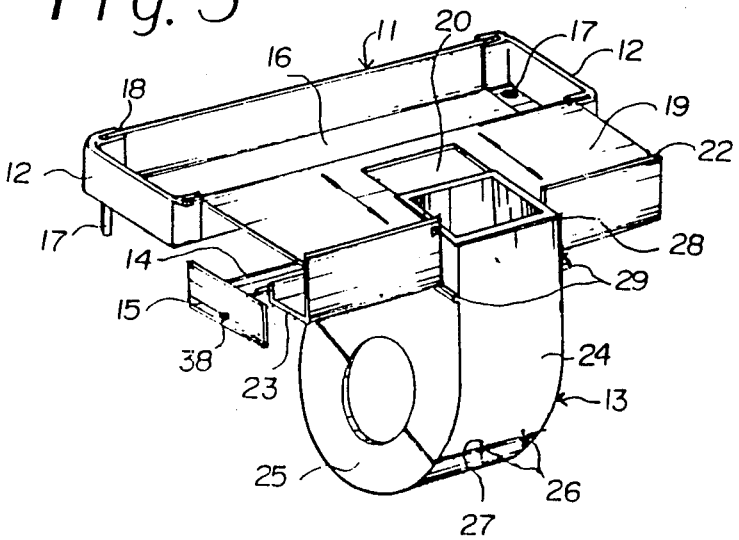
FIG. 3 is a perspective view of showing the plastic primary pan and pan covers of the present invention in an inserting position.

In assembly, the engaging plates 15 are attached to both ends of the channeled supporting bracket 14 through the U-shaped apertures 37 of the engaging plates 15. Thereafter, the engaging plates 15 are attached to the walls of the housing of the air conditioning system with the inclination for easily drawing condensate water through one of the drain pipes 17. After the fan cover 13 containing a fan (not shown) is combined together with the pins 27 through the pin engagements 26, the channeled supporting bracket 14 is engaged with the combined fan cover 13 by the screw 32 through the elongated slots 30 and the aperture 34 of the upper fan cover 24. And the motor 31 is mounted to the plastic supporting bracket 14 by screws 32 through the elongated apertures 35 of the supporting bracket 14 and the apertures 34 of the motor plate 33. The plastic primary pan body 11 is assembled with the pair of side walls 12 having drain pipes 17. The fan cover 13 is engaged with the supporting bracket 14 containing the motor 31. Finally, the fan cover 24 is assembled with the plastic primary pan 12 having the plastic support plate 19 by inserting the circumferential portion 20 and side ends 23' of the plastic support plate 19 into the rails raised portion 28' and 29 of the fan cover 13. Thus the circumferential raised portion 28' of the upper fan cover 24 are engaged with the end portion of the C-shaped circumferential portion 20 of the plastic support plate 19 (FIG. 3). Thereafter, the fan is inserted into the upper pan cover 24. Thereafter, the lower fan cover 25 is assembled with the upper pan cover 24 by inserting pins 27 into the pin engagements 26 thereof.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A primary pan assembly adapted to be mounted to the motor of an air conditioning system which comprises:

a plastic primary pan provided with a drainage hole disposed on at least one side thereof, a plastic support plate extended from said plastic primary pan, said plastic support plate containing a C-shaped circumferential portion on one side thereof and extending a C-shaped plate, said C-shaped plate having a pair of slots in the vicinity of both ends of said C-shaped circumferential portion, a channeled supporting bracket having a plurality of elongated apertures disposed in the center thereof for supporting said plastic primary pan, a motor mounted to said channeled supporting bracket by screws through said elongated apertures, and a fan cover having elongated slots disposed on the top surface thereof for receiving said supporting bracket, circumferential raised portion disposed around a below outlet, and both rails disposed on both side surfaces thereof, said both rails disposed in parallel with said circumferential raised portion for suspending said fan cover on said C-shaped circumferential portion and said C-shaped plate of the plastic support plate through said pair of slots, whereby the primary pan assembly can be mounted to housing walls of the air conditioner system at an inclination for easily draining the condensate water through the drainage hole and can be easily installed without a large number of screws and a large space for working, and the primary pan can be smoothly mounted to and separated from the channeled supporting bracket.

2. The primary pan assembly of claim 1, wherein the plastic primary pan defines a plastic primary pan body with a pair of pan walls, said plastic primary pan extending said support plate and said pair of walls containing at least one drainage hole, respectively.

3. The primary pan assembly of claim 2, wherein the pair of walls include a rail for receiving said plastic primary pan body, respectively.

4. The primary pan assembly of claim 1, wherein the channeled supporting bracket is provided with a pair of engaging plates which have U-shaped apertures formed between U-shaped rails thereon for receiving said channeled supporting bracket, said engaging plates being installable onto the housing wall of the air conditioning system.

5. The primary pan assembly of claim 1, wherein the channeled supporting bracket is made of aluminum.

6. The primary pan assembly of claim 1, wherein the channeled supporting bracket is made of steel.

7. The primary pan assembly of claim 1, wherein the channeled supporting bracket is made of plastic.

8. The primary pan assembly of claim 1, wherein the fan cover is assembled with an upper fan cover and a lower fan cover by inserting pins into pin engagements for easily inserting a fan thereinto.

* * * * *